US006293335B1

(12) United States Patent
Tawney et al.

(10) Patent No.: US 6,293,335 B1
(45) Date of Patent: Sep. 25, 2001

(54) METHOD AND APPARATUS FOR OPTIMIZING HEAT TRANSFER IN A TUBE AND SHELL HEAT EXCHANGER

(75) Inventors: Jeffrey Tawney, St Petersburg; Davod Denorcy, Bradenton; Dave Smith, St. Pete; Michael Patrick, Clearwater, all of FL (US)

(73) Assignee: AquaCal, Inc., St. Petersburg, FL (US)

( * ) Notice: Subject to any disclaimer, the term of this patent is extended or adjusted under 35 U.S.C. 154(b) by 0 days.

(21) Appl. No.: 09/344,210

(22) Filed: Jun. 24, 1999

(51) Int. Cl.[7] ..... F28D 7/12; F28D 9/00; F28F 3/12; F28F 1/14

(52) U.S. Cl. ..... 165/156; 165/155; 165/162; 165/163; 165/168; 165/184

(58) Field of Search ..... 165/162, 163, 165/168, 170, 155, 156, 184

(56) References Cited

U.S. PATENT DOCUMENTS 2,152,280 * 3/1939 Rapuano ..... 165/156
3,696,636 * 10/1972 Mille ..... 165/163
3,828,575 * 8/1974 Mallosky et al. ..... 165/163
3,921,708 * 11/1975 Brenner ..... 165/159
4,086,959 * 5/1978 Habdas ..... 165/155
4,522,256 * 6/1985 Wolfseder ..... 165/111
4,719,969 * 1/1988 Patton et al. ..... 165/163
4,739,634 * 4/1988 Watanabe ..... 165/169
5,487,423 * 1/1996 Romero ..... 165/163
6,019,168 * 2/2000 Kinnersly ..... 165/154

* cited by examiner

*Primary Examiner*—Ira S. Lazarus
*Assistant Examiner*—Tho V Duong
(74) *Attorney, Agent, or Firm*—Clifford A. Poff

(57) ABSTRACT

A tube and shell heat exchanger having a transversely oriented inlet port and a spirally coiled heat transfer tube contained within an arcuate chamber created by an internal baffle in which the water to be conditioned travels along a helical pathway in which the flow has minimized water depth and high turbulence. The tube and shell heat exchanger maximizes heat transfer capability in a relatively easy to assemble design to make feasible the use of a higher cost material for the tubing such as titanium in a wide range of applications.

14 Claims, 14 Drawing Sheets

METHOD AND APPARATUS FOR OPTIMIZING HEAT TRANSFER IN A TUBE AND SHELL HEAT EXCHANGER

BACKGROUND OF THE INVENTION

1. Field of the Invention: The present invention relates to a heat exchanger for thermal conditioning of one fluid medium by heat transfer with a second fluid medium in a heat transfer tube and, more particularly, to a method and apparatus for enhancing heat transfer between the flow of one heat transfer medium and a different heat transfer medium in an evaporator unit or condenser unit for diverse applications of heat transfer including water heaters and water coolers particularly, for water of swimming pools, spas, aquariums (both fresh and salt water) and as a heat exchanger for marine engines and in heat pumps.

2. Description of the Prior Art: Evaporator and condenser functions provided by a heat exchanger are commonly used for diverse applications and while not so limited, the present invention is particularly useful in one common field of used where heat transfer with one medium consists of a flow of water for a swimming pool or spa. Swimming pool water is heated or cooled depending on the climate affecting the temperature of the pool water. The present invention is particularly applicable to a heat exchanger using a tube-in-shell construction. It is known to heat a flow of water for a swimming pool in an elongated tank having an internal chamber in which an electrically resistive heating element, frequently as a coil, is housed. Water is directed in a lengthwise path through the tank chamber containing the heating element for transfer of heat from the heating element to the water. In such a device, no control over the flow of water is provided within the internal chamber of the tank and because the heat exchanger incorporates an electrically resistive heating element as opposed to a fluid heat transfer medium, the application of such a heat exchanger is limited to use as a heater for water.

It is well known in the art to provide a heat exchanger to condition a flow of water in which a fluid is used as a heat transfer medium. In a type of construction known as "shell-and-tube" design, the heat transfer fluid is carried within a tube and the flow of water to be treated is directed past the tube, or tubes, within a shell housing. In the simplest arrangement, the heat exchanger consists of a tube within a tube and the fluids move either in the same direction, known as a "parallel flow" heat exchanger, or in opposite direction, known as a "counter flow" heat exchanger. In a tube within a tube construction, there is no control over the flow of water once it has entered the shell. Such a construction, although embodying a simple arrangement of parts, is costly as to fabrication.

Other shell-and-tube heat exchanges are known in which multiple tubes, or a coiled tube, are housed within a shell. The heat transfer tube is commonly formed from a metal such as copper or copper-nickel alloy to take advantage of favorable heat transfer properties and low cost of the metal material. Because of the favorable heat transfer properties with metals as copper and copper-nickel alloy, when heating an increased water flow is necessary the requirement is met by increasing the length of copper tubing in the coiled section thereby providing a greater residence time for the water flow in the heat exchanger. Where higher BTU heat transfer is needed for a given flow of water through the shell, providing a greater length of tubing to achieve the desired BTU heat transfer is conventional and cost effective rather than direct or otherwise manage the water flow to maximize heat transfer.

There are disadvantages associated with a copper heat transfer tube in a heat exchanger for water. One example of such disadvantages is in the thermal conditioning of salt water for applications such as holding tanks and aquariums for marine life. The marine life is susceptible to a toxic reaction to chemically produce products of corrosive reaction between the salt water and the copper metal of the heat transfer tube. The toxic reacting product can be eliminated by selecting a more chemically inert metal or alloy such as titanium to form the heat transfer tube in the heat exchanger. The use of titanium for the heat transfer tube of the heat exchanger offers the benefits of strength, durability and a prolonged service life as compared with copper for the heat transfer tube of a heat exchanger. However, to be economically competitive the high cost of titanium metals as compared with the cost of copper or copper-nickel alloy poses a need to reduce the length of heat exchanged tubing. What is also needed is a heat exchanger construction in which the heat transfer between a fluid medium directed through a shell along a heat transfer tube is greatly enhanced by causing turbulence to the fluid media to maximize heat transfer thereby reducing the usage of high cost heat transfer materials, such as titanium.

Accordingly, it is an object of the present invention to provide a heat exchanger for conditioning a flow of a fluid medium within a shell along a helical pathway to maximize heat transfer between a fluid medium and heat transfer tubing.

It is a further object of the present invention to provide a heat exchanger for conditioning a flow of a fluid medium in which an internal baffle creates an arcuate chamber containing a tube coil such that the volume for the flow of a fluid medium is reduced and the fluid flow caused purposely to undergo high turbulence to maximize heat transfer between the fluid medium and the external surface of the tube coil.

It is another object of the present invention to provide a heat exchanger for conditioning a fluid medium in which the flow of the fluid medium within a shell is controlled to maximize the heat transfer capability with a heat transfer tube to make feasible a reduction to the length of coiled tubing and use of higher cost metal as the tube material such as titanium.

It is a further object of the present invention to provide a heat exchanger for conditioning a flow of a fluid medium in which an internal baffle is provided to create an arcuate chamber containing the coiled portion of a tube such that a fluid medium volume in the vicinity of the arcuate chamber is reduced and fluid flow is highly turbulent to maximize a temperature differential and thereby BTU transfer rate to a fluid medium along the coiled portion of the tube and a fluid medium.

It is still a further object of the present invention to provide a heat exchanger for conditioning a flow of a fluid medium in which the flow of the fluid medium within a shell is controlled for maximizing heat transfer by components for which assembly is relatively uncomplicated to use higher cost material for the heat exchange tube in a heat exchanger useful in a wider range of applications.

SUMMARY OF THE INVENTION

According to the present invention there is provided a heat exchanger to thermally condition a fluid medium, the heat exchanger including the combination of a shell including end walls forming an elongated internal cavity for heat transfer between fluid media, shell conduits forming an inlet port and an outlet port arranged at spaced sites along the elongated internal cavity for conducting a flow of a first fluid medium of the fluid media, a baffle elongated to extend along the elongated internal cavity and define therewith an elongated heat exchange chamber between an inner periphery of the shell and the baffle, and an elongated tubular conduit for conducting a flow of a second fluid medium of the fluid media, the elongated tubular conduit having a coiled portion extending in a helical fashion and resident in the elongated heat exchange chamber for heat transfer with the first fluid medium while a resident in and flowing at least substantially along the coiled portion of the elongated tubular conduit.

According to the present invention there is also provided a heat exchanger to thermally condition a first fluid medium, the heat exchanger including the combination of an elongated shell closed by end walls to form an internal cavity with spaced apart water inlet and outlet ports for the first fluid medium, an elongated baffle arranged in the internal cavity to define therewith an arcuate chamber between an inner periphery wall of the shell and the baffle, and an elongated heat transfer member having a coiled portion in the arcuate chamber forming a swirling pathway for the flow of the first fluid medium substantially along the coiled portion of the heat transfer member to maximize a temperature differential for heat transfer between the first fluid medium in the swirling pathway and the heat transfer member.

The present invention provides a method for thermally conditioning a flow of a fluid medium, the method including the steps of creating a turbulent heat exchange pathway extending helically from a supply chamber to a discharge chamber for conducting a first fluid medium of heat transfer media, providing a spirally coiled portion of a heat exchange conduit in the turbulent heat exchange pathway for conducting a second fluid medium of heat transfer media, the first fluid medium and the second fluid medium having a temperature differential sufficient to cause heat transfer from one of the heat transfer media to the other of the heat transfer media, and causing heat transfer through the heat exchange conduit by passing one of the heat transfer media along the turbulent heat exchange pathway and passing the other of the heat exchange medium along the spiral coiled portion of the heat exchanger.

BRIEF DESCRIPTION OF THE DRAWINGS

The present invention will be more fully understood when the following description is read in light of the accompanying drawings in which.

DETAILED DESCRIPTION OF THE EMBODIMENTS OF THE PRESENT INVENTION

Figure 2:
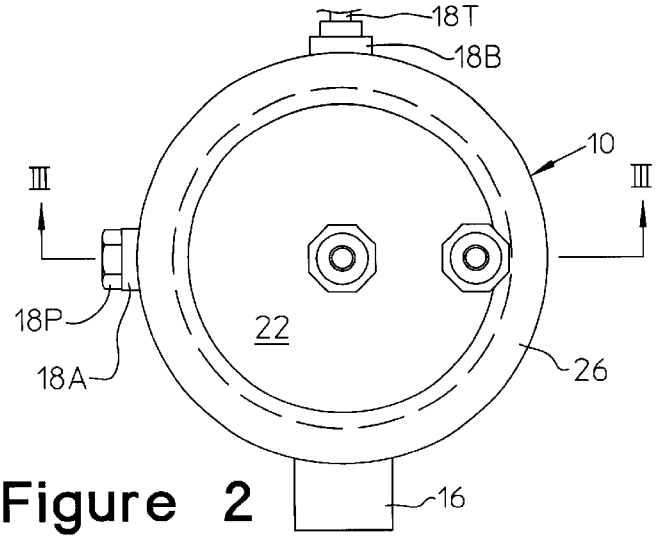
FIGS. 1 and 2 are side elevational and top views, respectively, of a first embodiment of a heat exchanger according to the present invention.
Figure 1:
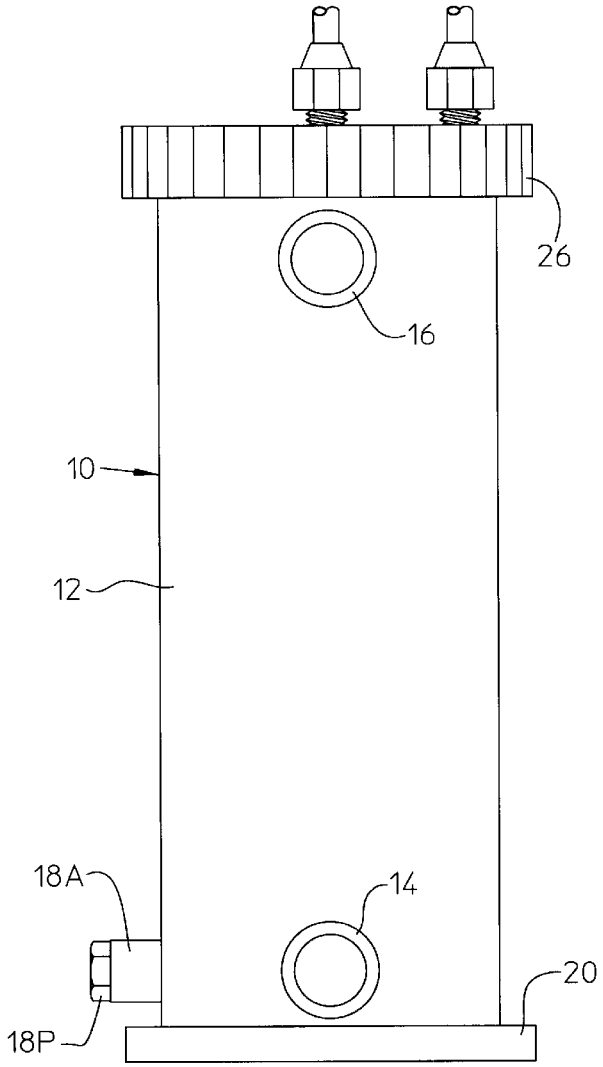
Figure 4:
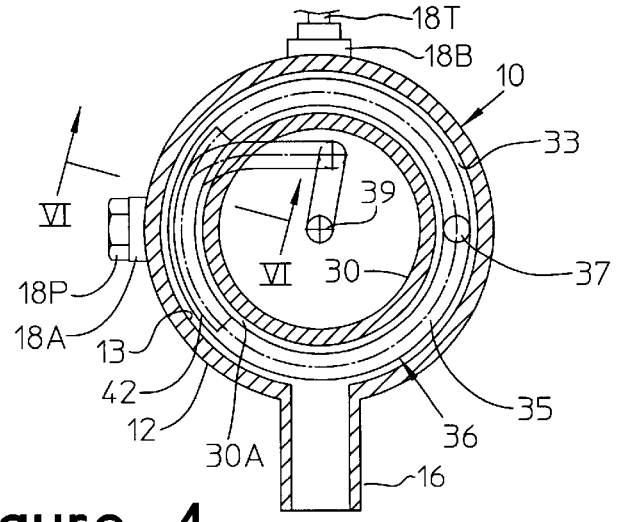
FIG. 4 is a sectional view taken along lines IV—IV of FIG. 3.

Referring to FIGS. 1–4, there is shown a first embodiment of a heat exchanger 10 embodying a construction and the arrangement of parts useful to form an evaporator unit or condenser unit for diverse applications including water heaters, water coolers particularly, for swimming pool water of swimming pools, spas, aquariums (both fresh and salt water), a heat exchanger for marine engines and heat pumps. The heat exchanger includes a cylindrical outer shell 12 providing a cylindrical internal face surface 13. The shell 12 has a fluid inlet port 14 located adjacent the bottom of the shell through which a first fluid medium such as water is introduced into a supply chamber 14A of the heat exchanger and a fluid outlet port 16 located adjacent a discharge chamber 16A at the top of the shell from which the water exits the heat exchanger. The fluid inlet port 14 and fluid outlet port 16 each have a central axis oriented to extend radially and intersecting with a central longitudinal axis of the cylindrical internal face surface 13 of shell 12. This relation between these axes provides a perpendicular orientation between the inlet port 14 and the cylindrical cavity of the shell 12 which serves to impart a highly desired turbulent water flow in the supply chamber 14A providing an entrance path to a heat exchange pathway of the heat exchanger. At the same general elevation of inlet port 14 there is two angularly spaced apart access ports 18A and 18B each having a threaded opening communicating with the cylindrical cavity of shell 12. Port 18A is normally closed by a plug 18P threadedly engaged with the internal threads of the port. The internal threads of port 18B are used for threadedly mounting a thermal couple 18T to provide a readout of inlet water temperatures at a remote monitoring site.

The lower boundary to the supply chamber 14A is provided by a bottom plate 20 sealed in a fluid tight manner to the bottom of the shell 12 by welding to form a fluid tight connection of long continued integrity to withstand the operating pressures of the flowing fluid medium in the shell of the heat exchanger. Preferably the bottom plate 20 is formed as an integral part of the outer shell 12 constructed of a fiber reinforced plastic by, per se, a well-known molding process.

The outlet port 16 delivers a flow of water from the discharge chamber 16A at the top end portion of the heat exchanger where a top plate 22 forms an upper enclosure to the outer shell 12 of the heat exchanger to create a sealed chamber into which water to be conditioned is introduced via inlet port 14 and from which conditioned water is removed via outlet port 16. A seal 24, such as an "O" ring, is seated in an annular recess in the top plate 22 and establishes a fluid tight sealing function in response to a compressive force imparted to the top plate 22 by a nut 26 threadedly engaged with external threads on a sleeve 28 encircling the upper edge of the shell and welded to the shell or otherwise attached in a fluid tight manner.

Figure 5:
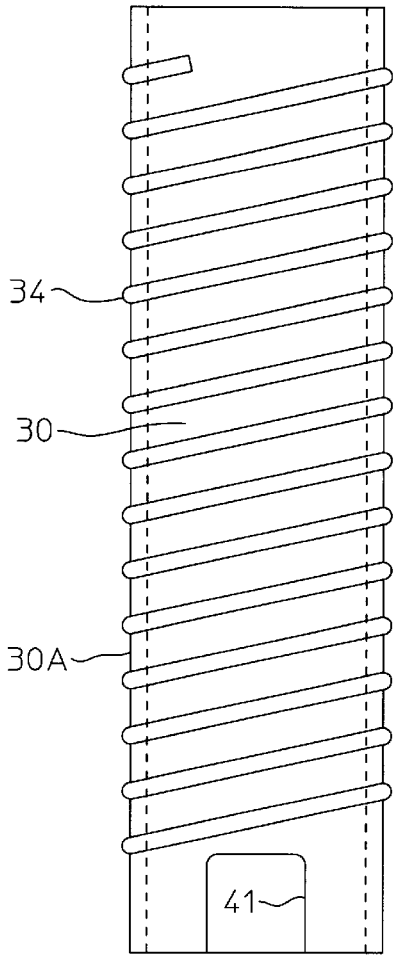
FIG. 5 is a side elevational view of a baffle forming part of the heat exchanger illustrated in FIG. 1.
Figure 7:
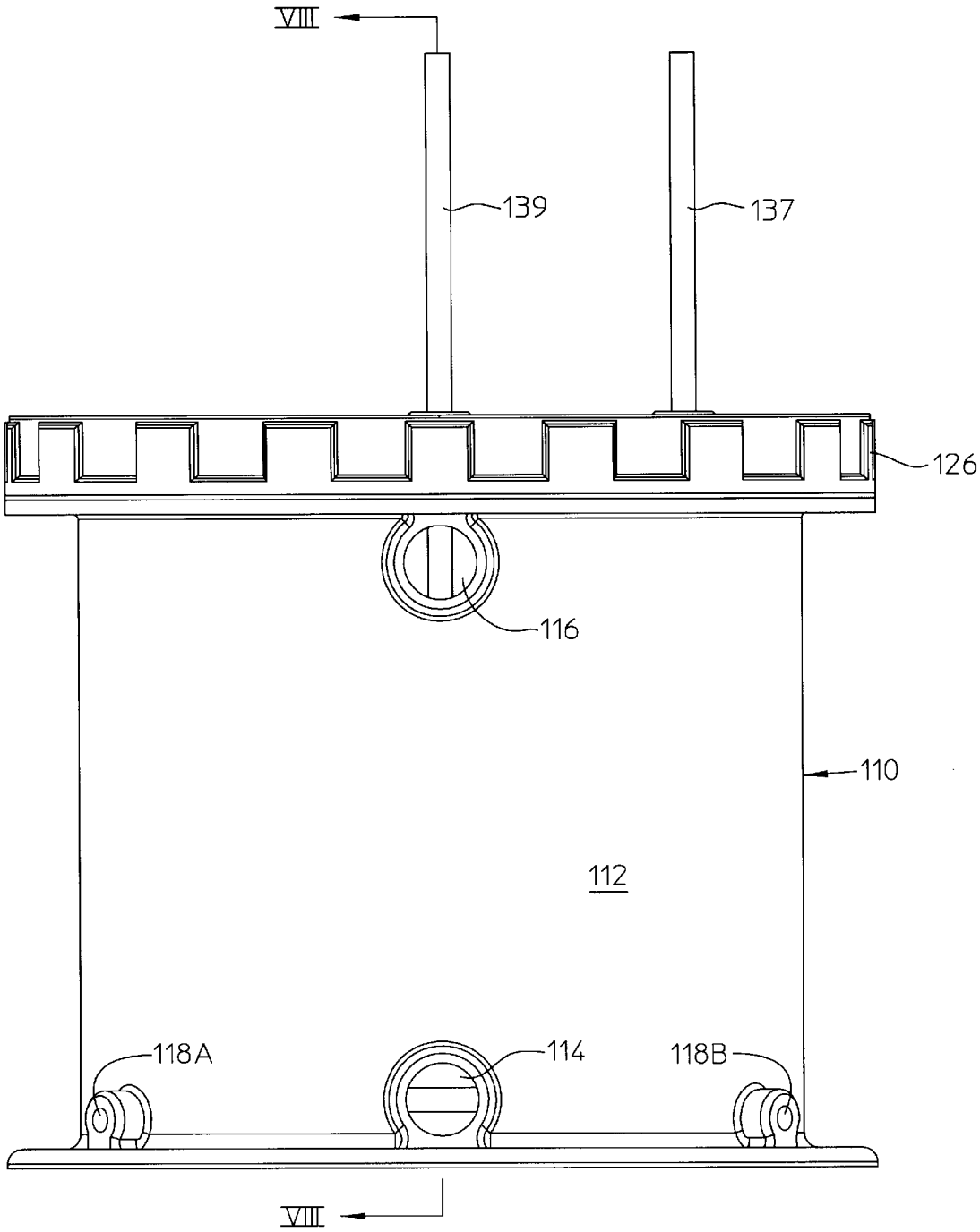
FIG. 7 is a front elevational view of a heat exchanger according to the preferred embodiment of the present invention.

An elongated cylindrical baffle 30 is seated at opposite ends thereof in annular grooves 31 and 32 centrally arranged in the bottom plate 20 and top plate 22, respectively. An elongated arcuate chamber 33 having the form of a circular ring is formed between an outer cylindrical surface 30A of the baffle 30 and the cylindrical internal face surface 13 of shell 12. The elongated arcuate chamber 33 is preferably provided with flow control surfaces obstructive to columnar and laminar flow conditions and designed to impart a turbulent flow characteristic to water flowing between inlet port 14 and outlet port 16. The flow of water entering the elongated arcuate chamber 33 through the inlet port 14 impinges with the outer cylindrical surface 30A of the baffle 30 which serves to initiate the turbulent nature of the flow of water entering the arcuate chamber 33 thereby avoiding the establishment of columnar or laminar fluid flow. As best seen in FIG. 5, one of the flow control surfaces is provided by the formation of a protrusion 34 protruding from the outer cylindrical surface 30A of baffle 30 and encircling the baffle in a helical fashion with a predetermined pitch. Another of the flow control surfaces is used in combination with the protrusion 34 and is helical convolution 35 forming part of a heat transfer tube 36. The helical convolutions 35 interleave with the protrusion 34 throughout the length of the arcuate chamber 33 and serve to establish a helical flow direction in the arcuate chamber 33 and maintain a turbulent, swirling advancing flow of water along a generally helical pathway formed by protrusion 34 and helical convolutions 35. The protrusion 34 is a protuberance having preferably a hemispherical cross-section to cause a turbulent and a swirling flow to the water flowing about the protrusion 34 thereby enhancing the heat transfer capability of the heat exchanger. The absence of sharp edges on the hemispherical cross section of the protrusion 34 and the remaining structure in the arcuate chamber 33 minimizes a press drop to the fluid flow.

The heat transfer tube 36 conducts a heat transfer fluid such as a compressible heat transfer medium, for example nonflammable gases and liquid fluorinated hydrocarbons used as refrigerants (sold under the trademark Freon) or a sensible heat transfer medium such as water, through the heat exchanger. The heat transfer tube 36 includes a generally straight inlet portion 37 extending exteriorly of the heat exchanger through an opening in top plate 22 provided with a compressive water tight seal 38 to the helical convolutions 35. The heat transfer tube 36 further includes an inner, generally straight, exit portion 39 extending through an opening in the top plate 22 provided with a compressive water tight seal 40. The straight exit portion 39 is centrally positioned to extend along the baffle 30 and at the end of the baffle adjacent bottom plate 20 the exit portion is joined by a right angled radial tube segment extending through opening 41 in the baffle and joined with the coiled portion and supported by an upstanding arcuate support 42. The support 42 maintains a spaced relation between the helical convolutions 35 and the bottom plate 20. The terminal end portions of inlet portion 37 and exit portion 39 are joined with conduits for the supply and discharge of the heat exchange medium. With this arrangement, the direction of flow for the heat transfer fluid within inlet portion 37 will move generally top to bottom and therefore opposite to the direction of flow of the second heat transfer fluid, such as water, to be conditioned within the arcuate chamber 33 which moves generally bottom to top. The preferred heat exchanger according to the present invention is therefore of a type referred to in the art as a "counterflow" heat exchanger. The heat transfer tube is supported by the top plate 22 through compressive water-tight seals 38 and 40, respectively, of inlet portion 37 and exit portion 39. The heat transfer tube is further supported near the bottom plate 20 by the curved arcuate support 42 which is located in a groove 44 in bottom plate 20.

Figure 3:
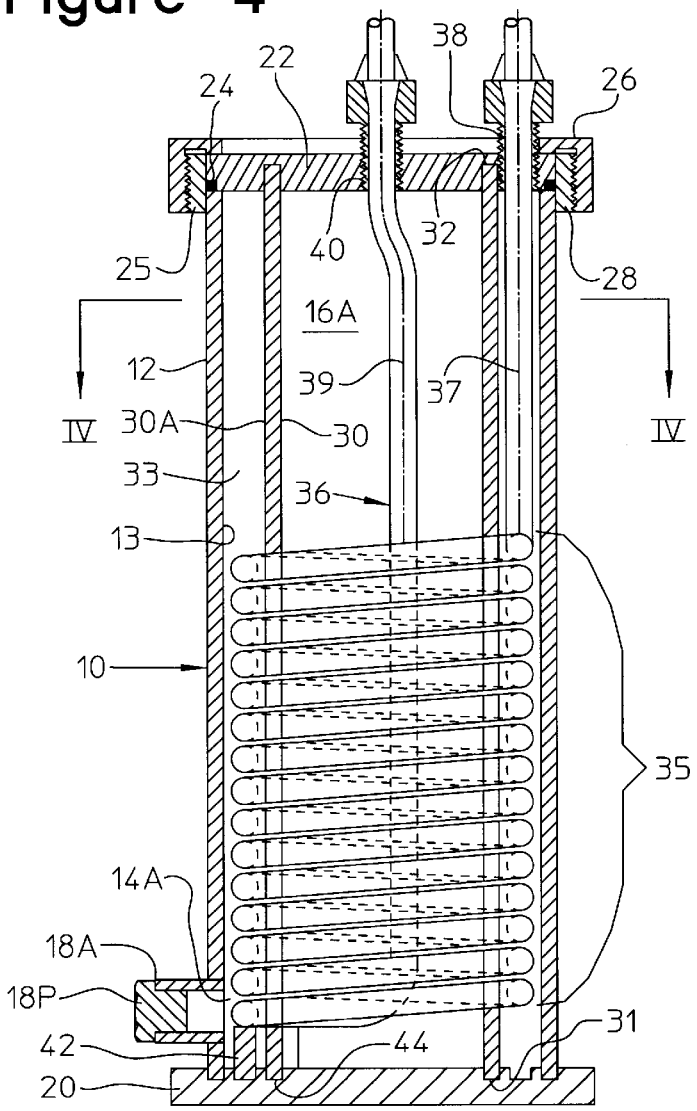
FIG. 3 is a section view taken along lines III—III of FIG. 2.

As seen in FIG. 3, the thickness of the arcuate chamber, defined as the radial distance between the inner surface 13 of shell 12 and the outer surface 30A of baffle 30, provides space for the helical convolutions 35 of the heat transfer tube 36 without excessive clearances between the helical convolutions 35 and each of the inner surface 13 and the outer surface 30A. The thickness of the arcuate chamber must be sufficiently narrow so that the water to be conditioned is conducted through the arcuate chamber 33 along a substantially helical pathway.

According to the present invention of the heat exchanger of FIGS. 1 to 5, is constructed to provide a greatly improved heat transfer capacity for a unit length of tubing thereby allowing for significant reduction in the overall length of tubing necessary to provide a given BTU heat transfer performance. This allows the use of less chemically reactive and more durable materials for the heat transfer tube 36 in comparison to other more typically utilized metals such as copper because of the more favorable heat transfer coefficient. First, the direction of the flow of water into the arcuate chamber 33 created by baffle 30 and containing the helical convolutions 35 increases tube surface area in contact with water for a given amount of water flow. Second, the impingement with the baffle 30 by the flow of water entering the arcuate chamber 33 enhances the turbulent nature of the flow of water thereby enhancing heat transfer capability. Third, the bottom-to-top substantially helical path flow of water within the arcuate chamber approximates an opposing flow path in the preferred counter flow arrangement with respect to the top-to-bottom flow path of the heat transfer medium within the helical convolutions 35. Finally, the construction of the heat exchanger of FIGS. 1 to 5 minimizes clearances between the helical convolutions 35 of tube 36 and the arcuate chamber surfaces of the baffle 30 and the shell 12. The reduced clearance provides a corresponding reduction to water flowing about the helical convolutions 35. The limited water depths and the highly turbulent water flow results in reduction of temperature gradients in the flowing water at any given location along a running length of the helical convolutions 35 of heat transfer tube 36. Such uniformity in temperature throughout the water at any given location along the coiled tube results in maximum heat transfer.

The preferred material for the heat transfer tube 36 is titanium. Titanium offers significant benefits in terms of strength and durability over other metals more commonly used for heat exchanger tubing, such as copper. Furthermore, titanium offers benefits over copper in those applications where contact between the copper tubing and the water being conditioned is undesirable, such as aquariums supporting marine life for which copper contamination could be toxic.

Figure 6:
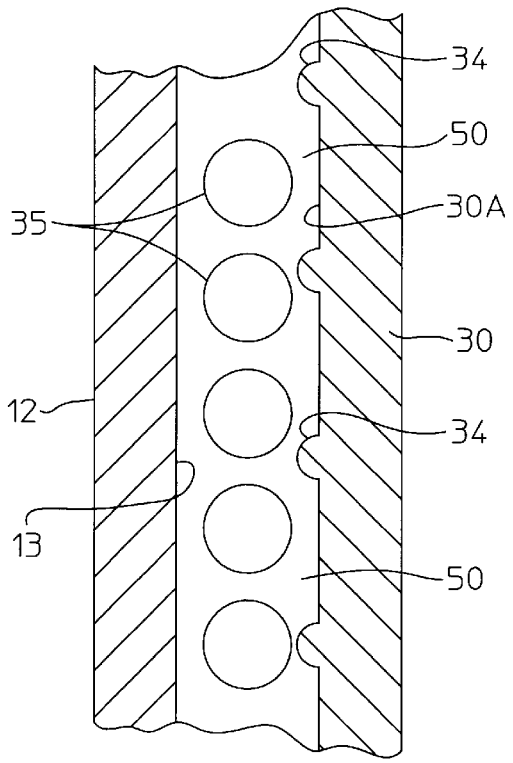
FIG. 6 is an enlarged sectional view taken along lines VI—VI of FIG. 4 illustrating the relationship between convolutions of a heat exchanger tube and a spiral projection on the baffle shown in FIG. 5 for providing a turbulent flow of a fluid medium along a helical pathway formed by the spiral projection.

Referring to the schematic illustration of FIG. 6, it may be seen that the pitch of the helical convolutions 35 of tube 36 varies from the pitch of the spiral protrusion 34 extending from baffle 30. This variation in pitch serves to prevent nesting between the convolutions of helical convolutions 35 and the spiral protrusion 34. The variation in pitch also creates a void space 50 between the spiral protrusion 34 of baffle 30 and the helical convolutions 35 of tube 36 which is ever changing in shape along the running length of either protrusion 34 or helical convolutions 35. The variation of the void space serves to maintain turbulence of the flow of water thereby facilitating thermal transfer between the water and the heat transfer tube 36.

In FIGS. 7–17 there is shown second and a preferred embodiment of a heat exchanger 110 according to the present invention. As in the first embodiment, the heat exchanger 110 embodies a construction and the arrangement of parts useful to form an evaporator unit or condenser unit for diverse applications including water heaters, water coolers particularly, for swimming pool water of swimming pools, spas, aquariums (both fresh and salt water), a heat exchanger for marine engines and heat pumps.

With particular reference now to FIGS. 7–11, the heat exchanger includes a cylindrical outer shell 112 providing a cylindrical internal face surface 113. The shell 112 has a fluid inlet port 114 located adjacent the bottom of the shell through which a first fluid medium, such as water, is introduced into a supply chamber 114A of the heat exchanger and a fluid outlet port 116 located adjacent a discharge chamber 116A at the top of the shell from which the water exits the heat exchanger. The fluid inlet port 114 and fluid outlet port 116 each have a central axis oriented to extend radially and intersecting with a central longitudinal axis of the cylindrical internal face surface 113 of shell 112. This relation between these axes provides a perpendicular orientation between the inlet port 114 and the cylindrical cavity of the shell 112 which serves to impart a highly desired turbulent water flow in the supply chamber 114A providing an entrance path to a heat exchange pathway of the heat exchanger. At the same general elevation of inlet port 114 there is two angularly spaced apart access ports 118A and 118B each having a threaded opening communicating with the cylindrical cavity of shell 112. Port 118A is normally closed by a plug; not shown, threadedly engaged with the internal threads of the port and used to allow water to be drained from the heat exchanger. The internal threads of port 118B are used for threadedly mounting a thermal couple, not shown, to provide a readout of inlet water temperatures at a remote monitoring site.

Figure 9:
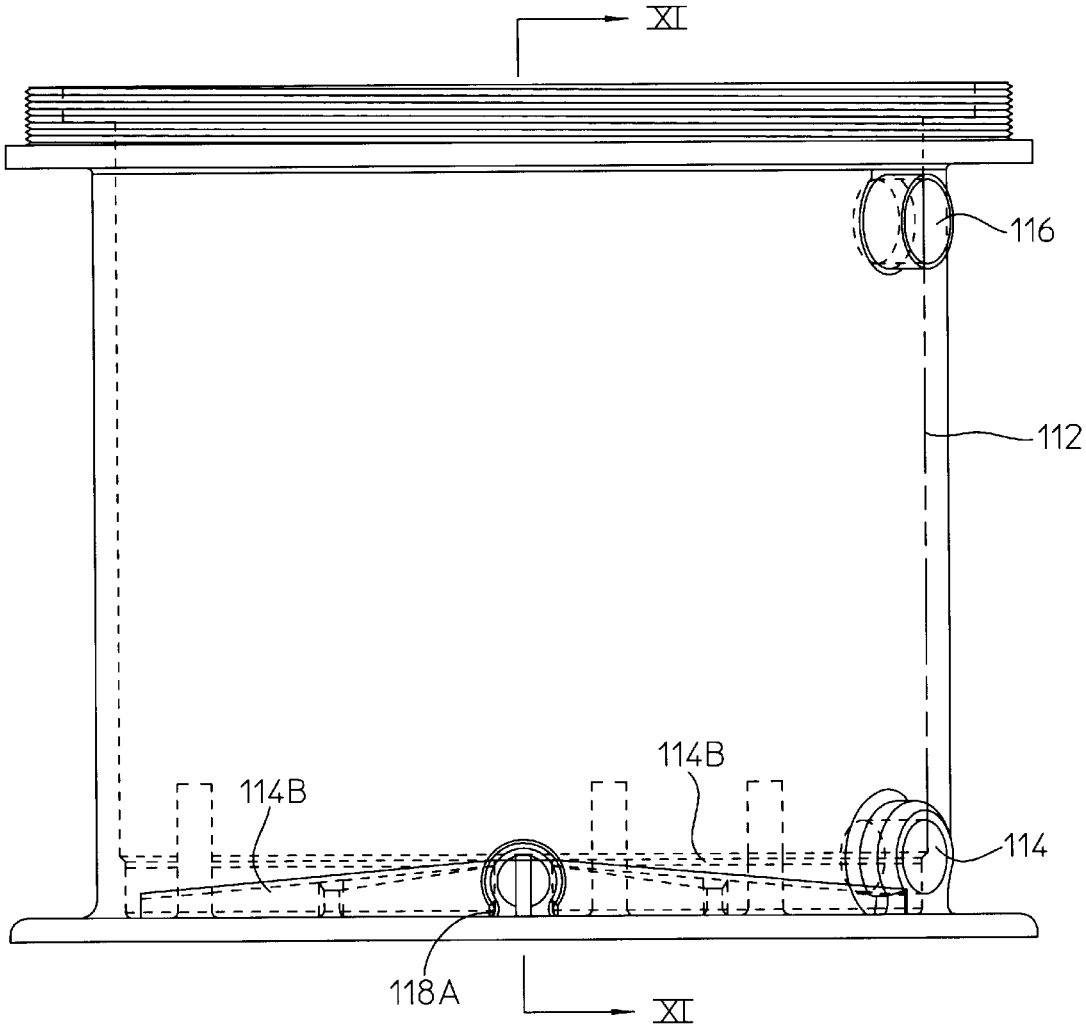
FIG. 9 is a side elevational view of the shell shown in FIGS. 7 and 8.
Figure 10:
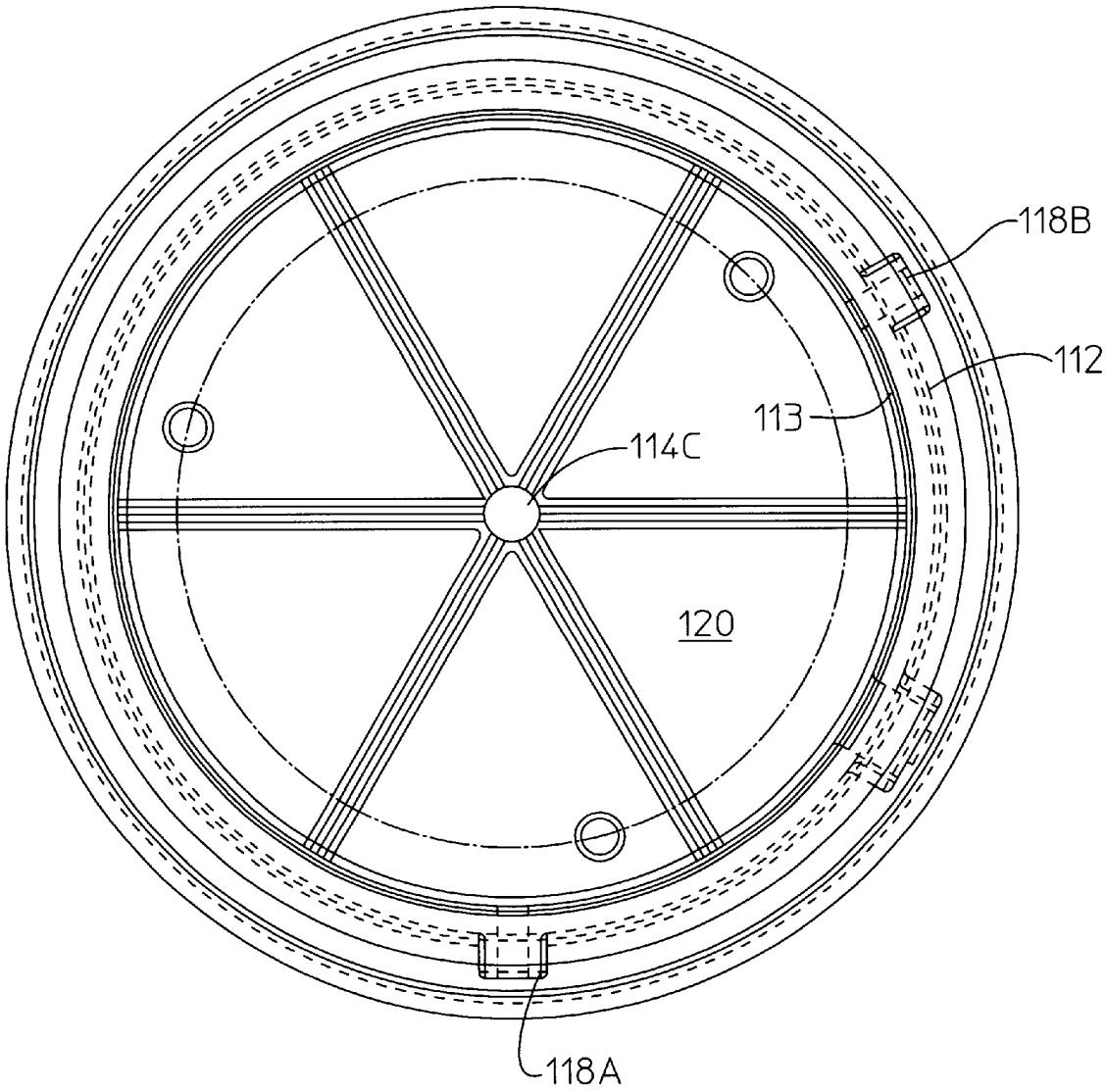
FIG. 10 is a plan view of the shell shown in FIG. 9.
Figure 11:
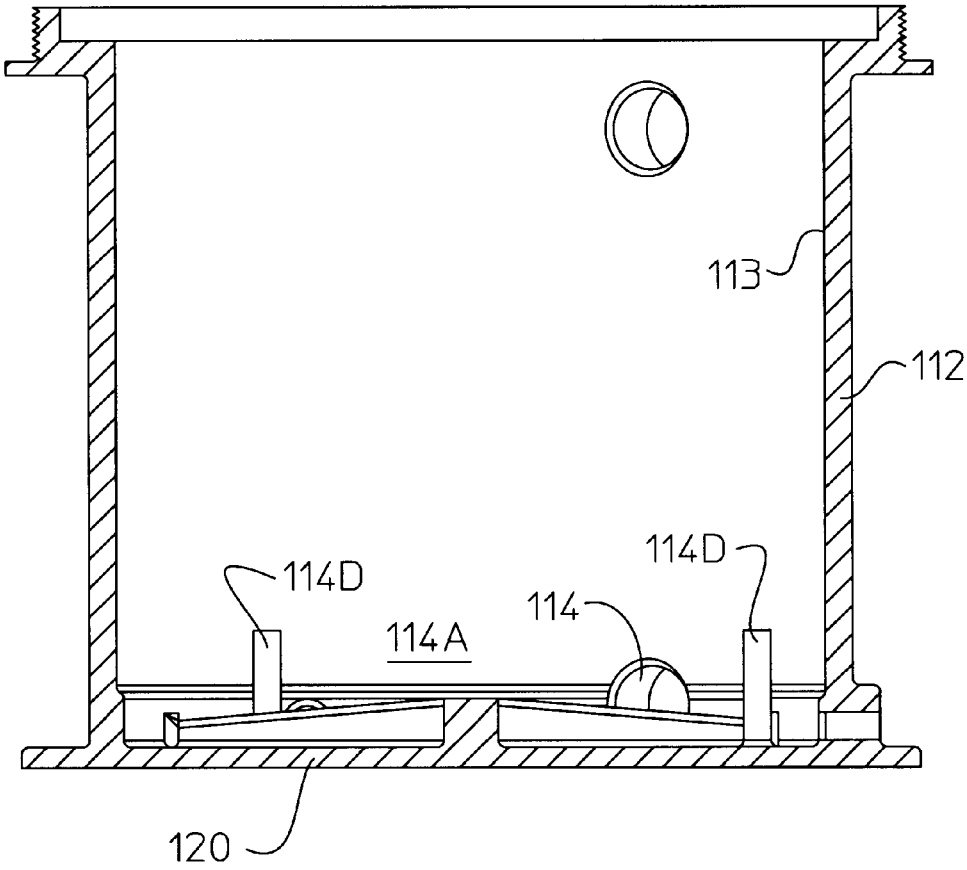
FIG. 11 is a sectional view taken along lines IX—IX of FIG. 9.

As shown in FIGS. 9, 10 and 11, the supply chamber 114A is bounded by a bottom wall 120 which is an integral part of shell 112 preferably constructed of a fiber reinforced plastic, per se, well-known in the art. The supply chamber 114A contains flow control vanes 114B extending radially from a centrally located hub 114C that protrudes extending to an elevation above the bottom wall 120 of effect approximately the lower half of the incoming flow of water through supply port 114. Additionally, there are three upstanding cylindrical posts 114D having a height which traverses the entire supply chamber 114. The combined affect by the flow control vanes 114B; the centrally located raised hub 114C and the upstanding cylindrical posts 114D is that of imparting turbulence to the incoming flow of water within supply chamber 114A The turbulence is the result of a complex water flow system having vertical, radial and rotational water flow components. The outlet port 116 delivers a flow of water from the discharge chamber 116A at the top end portion of the heat exchanger where a top plate 122 forms an upper enclosure to the shell 112 of the heat exchanger to create a sealed heat exchange chamber. A seal 124, such as an "O" ring, is seated in an annular recess in the top plate 122 and establishes a fluid tight sealing function in response to a compressive force imparted to the top plate 122 by a threaded nut 126 threadedly engaged with external threads on an upstanding rim section 128 encircling the upper edge of the shell 112.

FIGS. 8 and 13–16 illustrate a baffle 130 which includes a cylindrical side wall 130A closed by a generally planar top wall 130B having three vertically extending spacer posts 130C. The upper ends of these posts engage internal planar face surfaces 122A between raised ribs 122B (shown in FIGS. 8 and 12). The raised ribs joined with a centrally located collar projection having an annular passage way 122C for a vertical discharge section of a heat transfer tube and located radially outwardly thereof there is a collar projection having an annular passageway 122D for a vertical supply section of a heat transfer tube. The cylindrical wall 130A of baffle 130 is formed with a continuous cylindrical internal face surface 130D. The external surface of cylindrical side wall 130A includes a continuous helically arranged rib 131 protruding outwardly and forming between successive convolutions an helical heat exchange chamber 133 whose outer boundary consists of the cylindrical internal face surface 113 of shell 112. The outer edge of the rib 131 confronts with little or no gap, the inner face surface of the shell, resulting in a helical convolution of a heat exchange chamber 133 that approximates a parabola in cross section consisting of the volume between adjacent rib 131 bounded by the shell 112. The helical heat exchange chamber 133 is provided with flow control surfaces obstructive to columnar and laminar flow conditions and designed to impart a turbulent flow characteristic to water flowing between inlet port 114 and outlet port 116. The flow of water entering the helical heat exchange chamber 133 from supply chamber 114A is in an turbulent state and proceeds upwardly along diverse courses of travel consisting of chamber 133 and a plurality of vertically arranged linear pathways, there being four pathways 132A, 132B, 132C and 132D, shown in FIG. 14, arranged at annular intervals of 90°. Each pathway intercepts each consecutive helical convolution of the radially extending rib 131 and serve to maintain the turbulent nature of the flow of water passing along the arcuate chamber 133 thereby avoiding the establishment of columnar or laminar fluid flow. As best seen in FIGS. 13, 15, 16A and 16B, additional flow control surfaces are provided by upper and lower sets of tube constraint fingers 134U and 134L, respectively, protruding from the outer cylindrical surface of baffle 130. The upper tube constraint finger are located at vertically spaced apart intervals corresponding to the pitch of the helical convolution of rib 131 with each upper tube constraint finger situated adjacent the upwardly directed face of rib 131. The lower tube constraint fingers are located at vertically spaced apart intervals corresponding to the pitch of the helical convolution of rib 131 with each lower tube constraint finger situated adjacent the downwardly directed face of rib 131.

Figure 12:
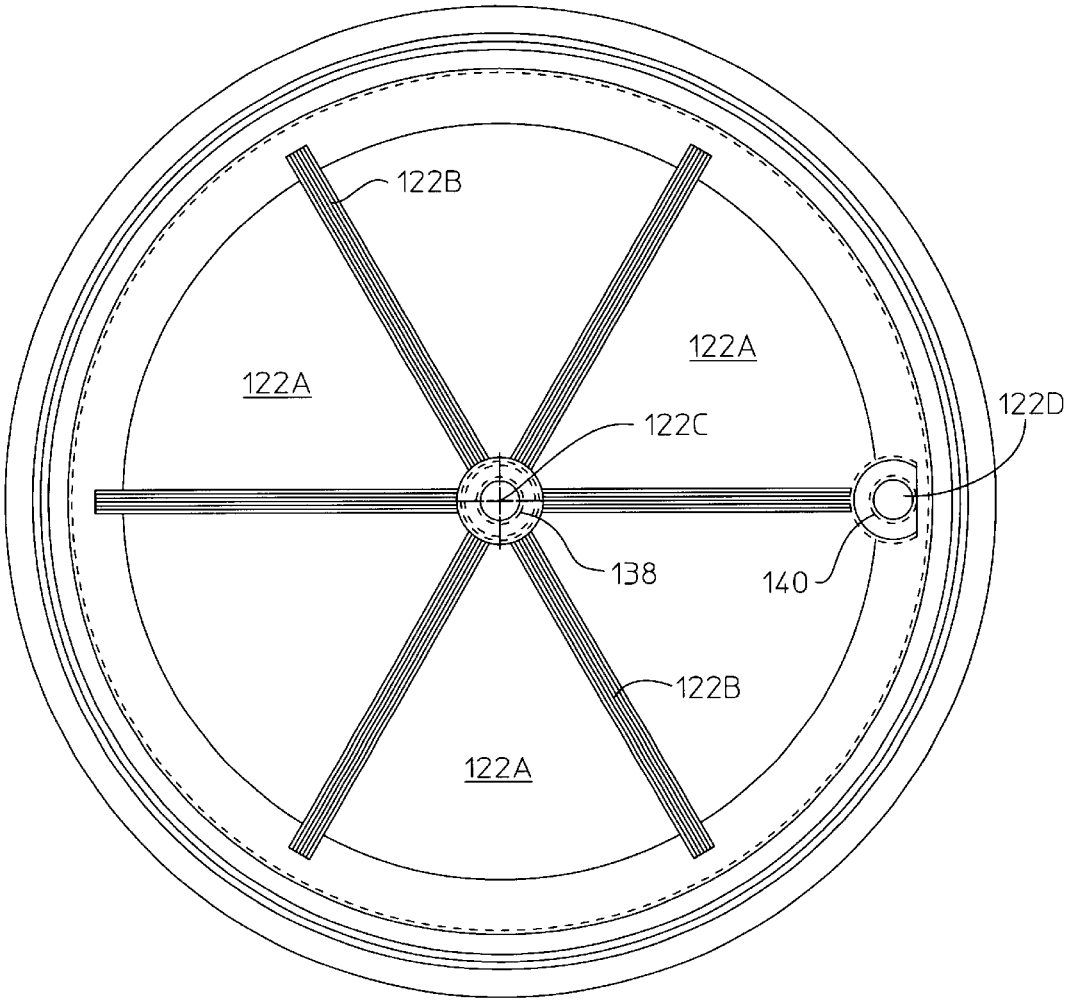
FIG. 12 is a bottom plan view of a lid forming part of the heat exchanger and taken along lines XII—XII of FIG. 8.
Figure 13:
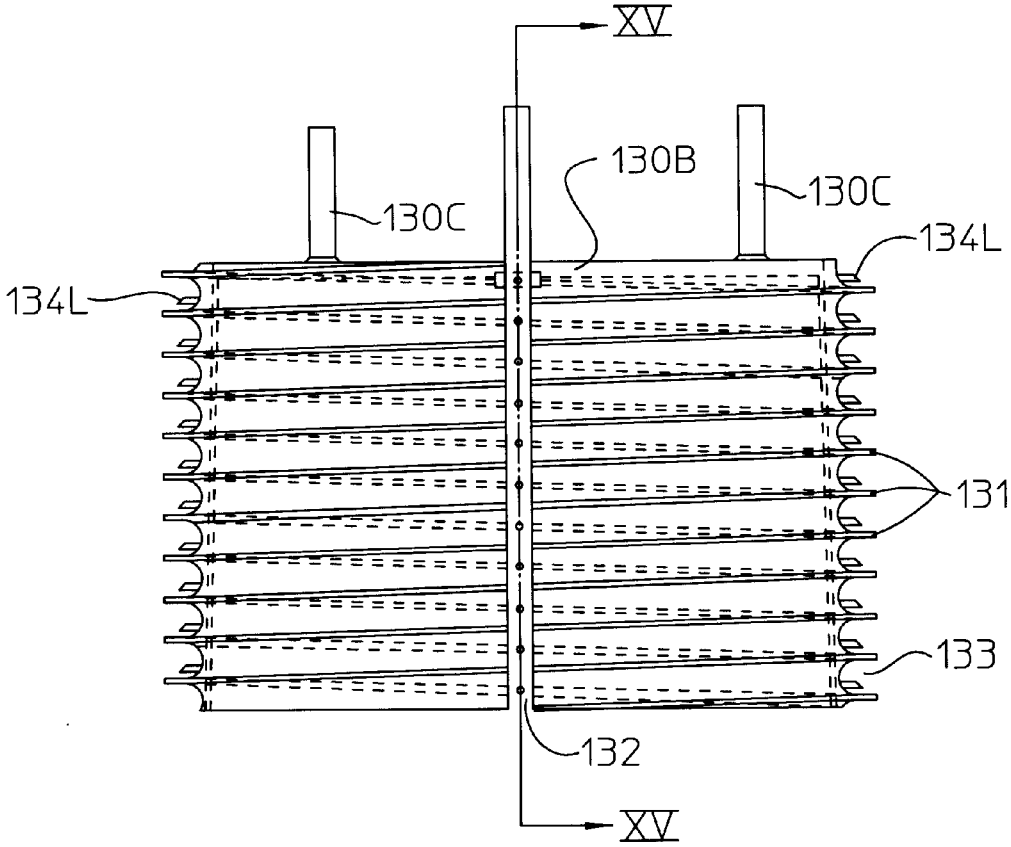
FIG. 13 is an elevational view of a baffle forming part of the heat exchanger shown in FIG. 8.
Figure 14:
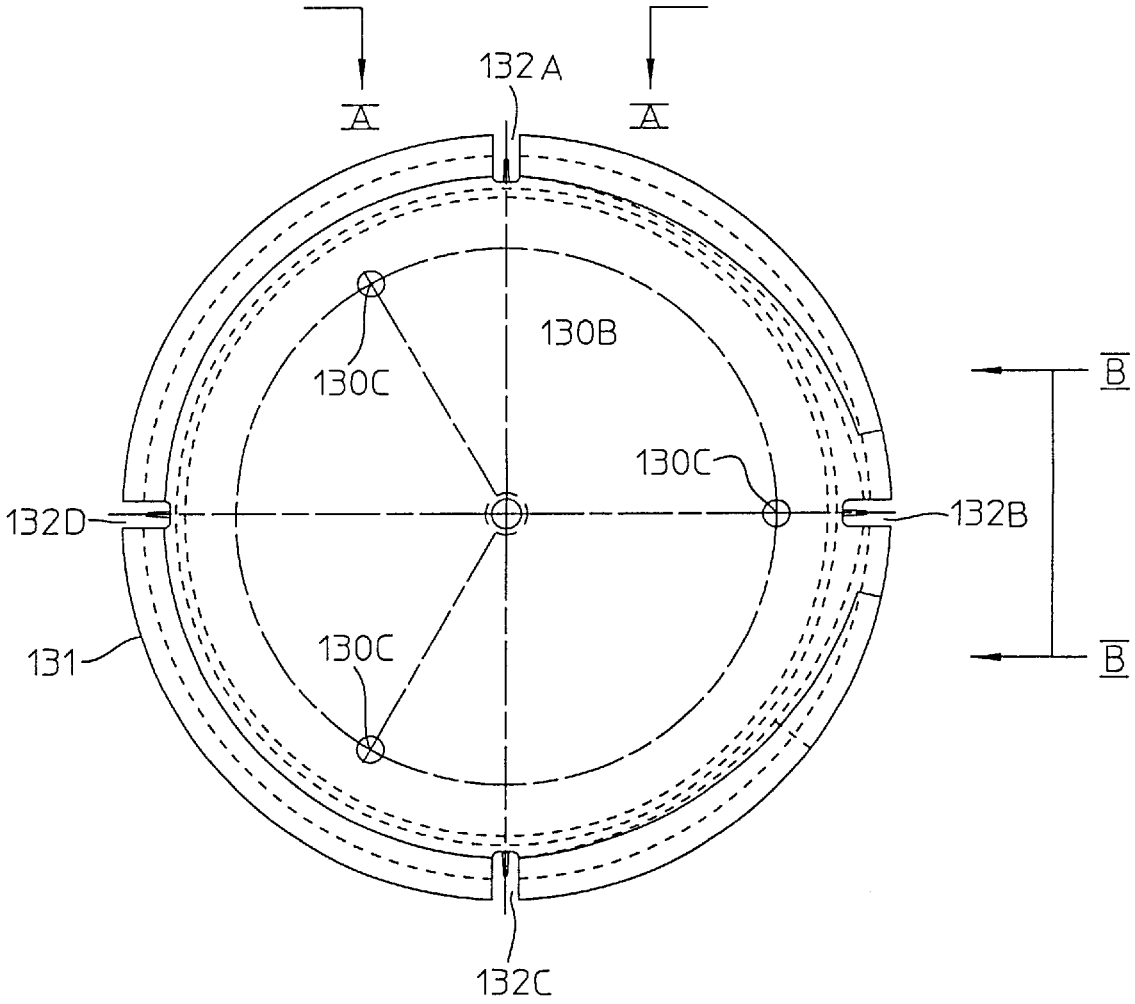
FIG. 14 is a top plan view of the baffle shown in FIG. 13.
Figure 15:
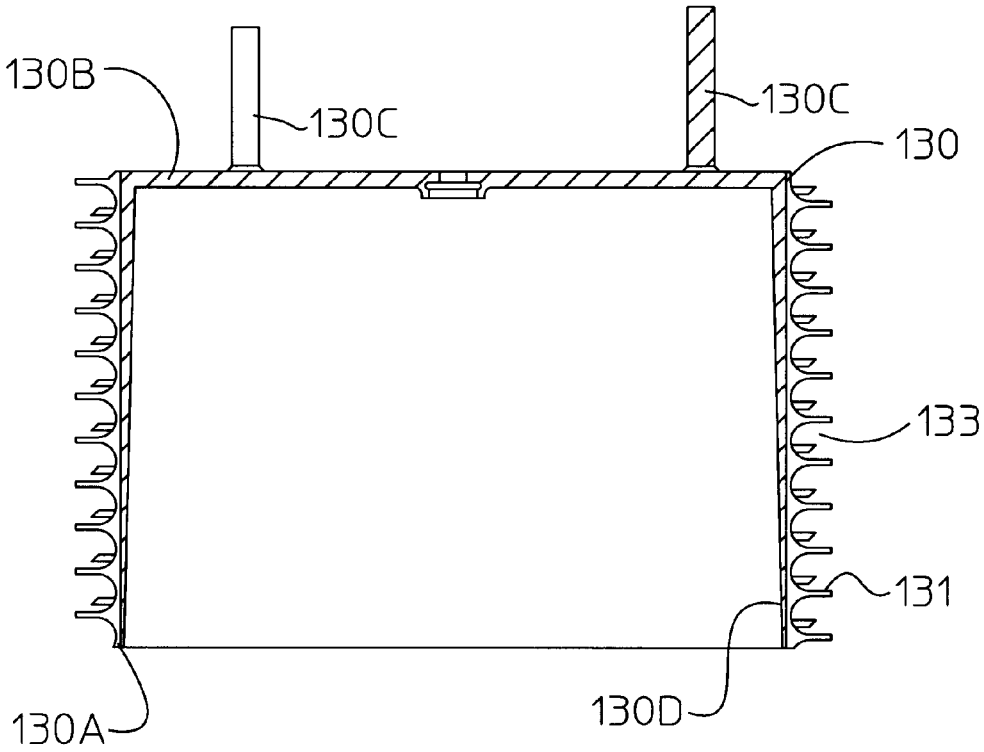
FIG. 15 is a sectional view taken along lines XV—XV of FIG. 13.
Figure 16B:
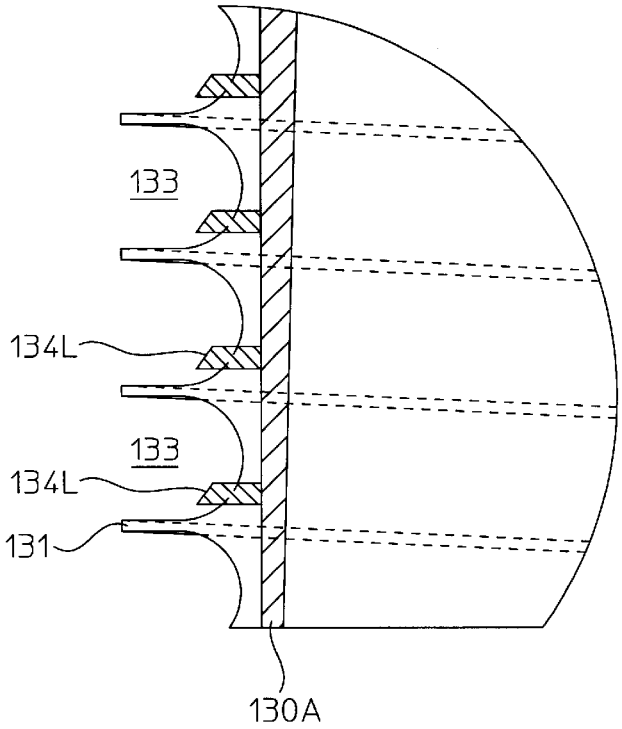
FIGS. 16A and 16B are enlarged fragmentary views taken along lines A—A and B—B, respectively, of FIG. 14.
Figure 16A:
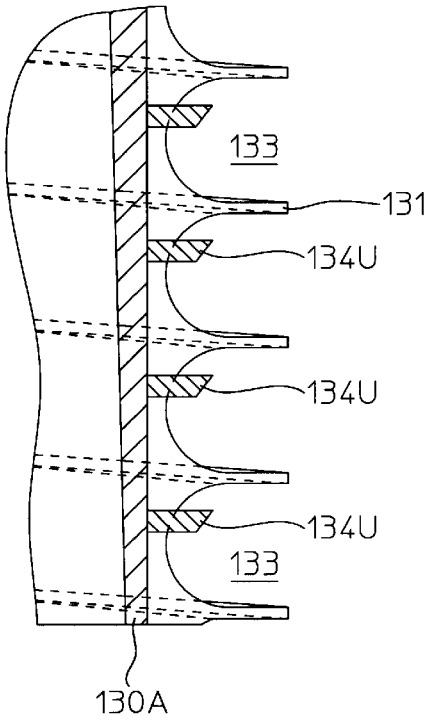
Figure 17:
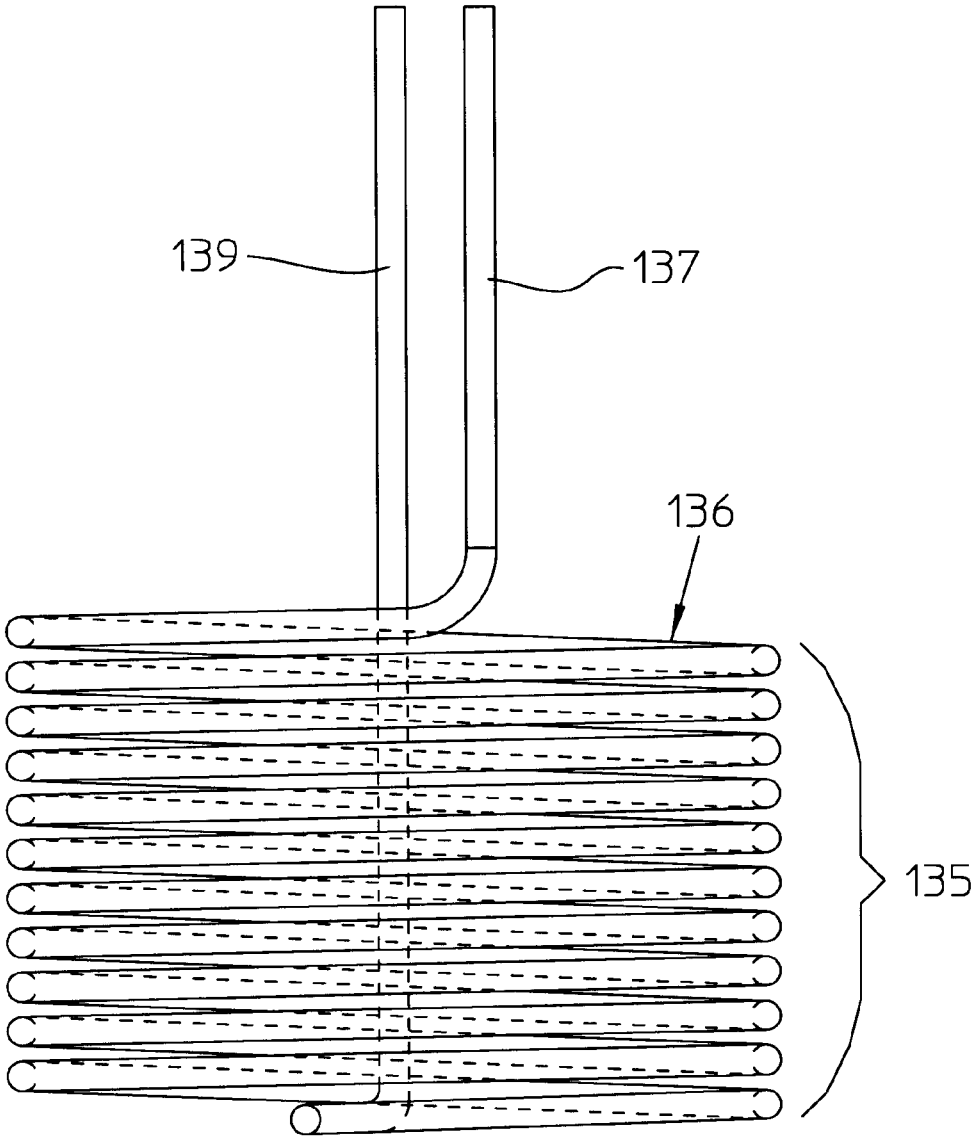
FIG. 17 is an elevational view of a coil forming part of the heat exchanger shown in FIG. 8.

Another of the flow control surfaces is helical convolution 135 forming part of a heat transfer tube 136 shown in FIG. 17. The tube 136 includes a vertically extending supply section 137 and a vertically extending discharge section 139 which extends through openings 122C and 122D, respectively, in a fluid tight manner provided by seals 138 and 140 (FIG. 12). The helical convolutions 135 interleave with the tube constraint fingers 134U and 134L throughout the length of the chamber 133 and serve to maintain a helical flow direction in the chamber 133. A swirling flow of water flowing about the chamber 133 enhances the heat transfer capability of the heat exchanger. In the preferred embodiment of the present invention the pitch of the helical convolutions 135 of the heat exchange tube is the same as the pitch of the helical heat exchange chamber 133. The absence of sharp edges in the arcuate chamber 133 minimizes a press drop to the fluid flow.

Figure 8:
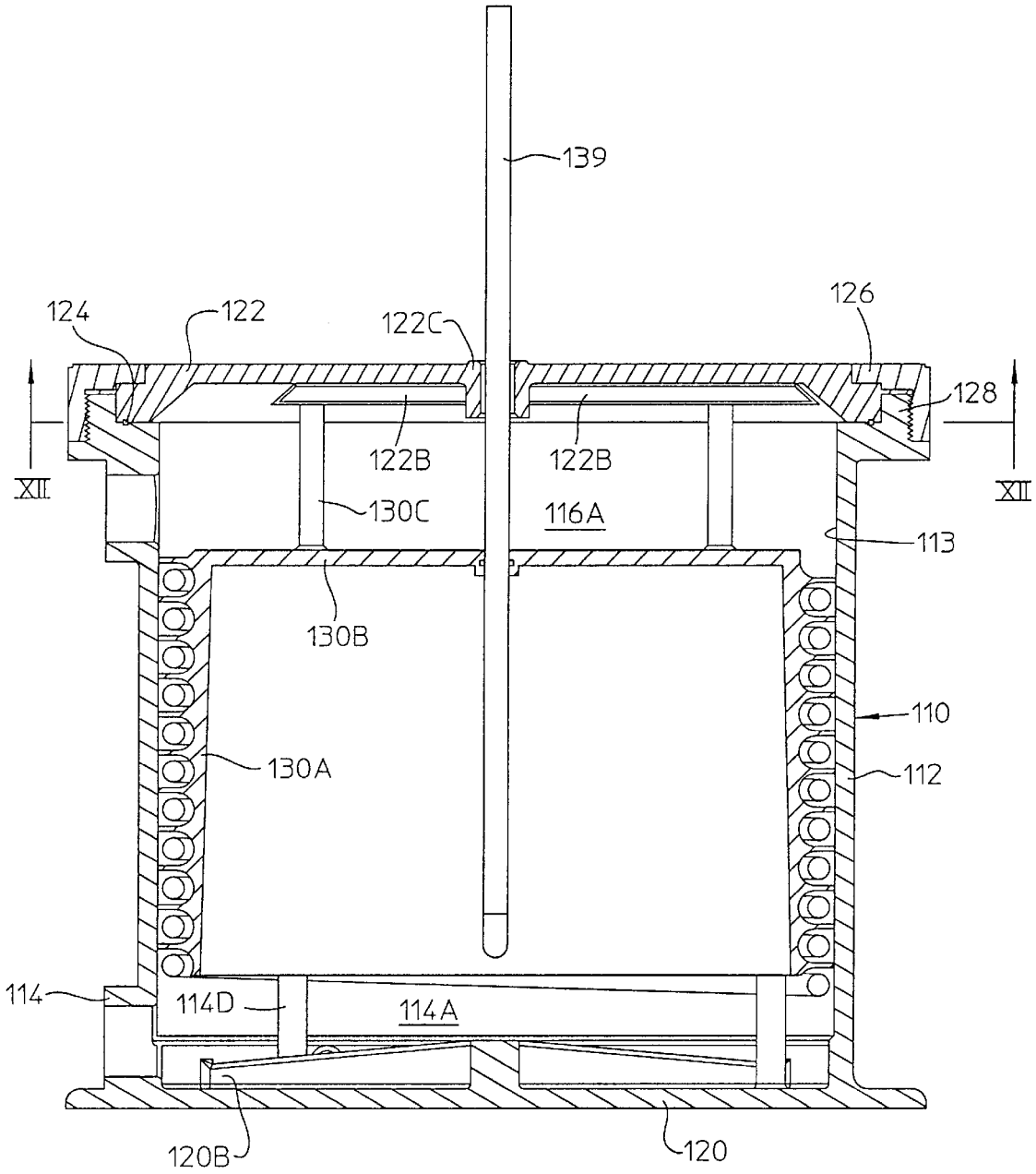
FIG. 8 is a sectional view taken along lines VIII—VIII of FIG. 7.

With this arrangement, the direction of flow for the heat transfer fluid within inlet portion 137 will move generally top to bottom and therefore opposite to the direction of flow of the second heat transfer fluid, such as water, to be conditioned within the chamber 133 which moves generally bottom to top. The preferred heat exchanger according to the present invention, is therefore of a type referred to in the art as a "counterflow" heat exchanger. The heat transfer tube is supported by the top plate 122 through compressive watertight seals 138 and 140, respectively, (FIG. 12) of inlet portion 137 and exit portion 139 (FIG. 17). The heat transfer tube is driven upwardly into a supporting relation with the top plate 122 by the resulting force imposed on the baffle 130 due to the unavoidable pressure drop from the resulting upward water flow in chamber 133. As can be seen in FIG. 8, the baffle 130 is supported between angularly spaced posts 114D at the bottom of the shell and by the angularly spaced posts 130C at the top of the shell.

According to the present invention the preferred embodiment of the heat exchanger construction shown and described in regard to FIGS. 7–17, provides a greatly improved heat transfer capacity for a unit length of tubing thereby allowing for significant reduction in the overall length of tubing necessary to provide a given BTU heat transfer performance. This achieves an objective of the invention to allow the use of less chemically reactive and more durable materials for the heat transfer tube 136 in comparison to other more typically utilized metals such as copper. Imparting a highly turbulent state to the water and supply chamber 114A and the flow of water upwardly both along the chamber 133 and vertical pathways 132A, 132B, 132C and 132D serves to maximize the temperature differential and thereby enhance heat transfer capability. The preferred material for the heat transfer tube 136 is titanium for the same reasons given hereinbefore in regard to heat transfer tube 36.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A heat exchanger to thermally condition a fluid medium including the combination of:

a shell including end walls forming an elongated internal cavity for heat transfer between fluid media, shell conduits forming an inlet port and an outlet port arranged at spaced sites along said elongated cavity for conducting a flow of a first fluid medium of said fluid media;

a baffle elongated to extend along said elongated internal cavity and define therewith an elongated helical heat exchange chamber between an inner periphery of said shell and said baffle, said baffle having an outer cylindrical surface containing a helical groove for a helical arrangement of projecting flow control surfaces for impact by said first fluid medium, said elongated heat exchange chamber consists at least substantially of a helical space formed between the inner surface of said shell and the helical groove of said baffle, one of said end walls being a bottom plate attached to said shell and having spaced apart supports extending into said shell for supporting said baffle within said shell at a distance from said bottom plate; and an elongated tubular conduit for conducting a flow of a second fluid medium of said fluid media, said elongated tubular conduit having a coiled portion extending in a helical fashion and resident in said elongated helical heat exchange chamber with said flow control surfaces for maximizing heat transfer with said first fluid medium while resident in and with turbulent flow of said first fluid medium by said flow control surfaces flowing at least substantially along said coiled portion of said elongated tubular conduit.

2. The heat exchanger according to claim 1 wherein the spirally coiled portion of said heat transfer member has a set pitch and wherein said baffle includes an elongated projection with a set pitch.

3. The heat exchanger according to claim 1 wherein said helical groove is formed by a continuous helically arranged rib along the outer surface of said baffle, said rib having outer edge confronting the inner surface of said shell for forming a helical to said heat exchange chamber.

4. The heat exchanger according to claim 1 wherein said elongated heat exchange chamber comprises a plurality angular spaced apart pathways intercepting each consecutive convolution of said helically outward rib.

5. The heat exchanger according to claim 2 wherein said elongated is a metallic tube consisting of titanium.

6. A method for thermally conditioning a flow of a fluid medium, said method including the steps of:

creating a turbulent heat exchange chamber extending helically from a supply chamber to a discharge chamber using flow control surfaces in a pathway intercepting consecutive convolutions of the helically extending chamber for conducting a first fluid medium of heat transfer media;

providing a spirally coiled portion of a heat exchange conduit in said turbulent heat exchange chamber for conducting a second fluid medium of heat transfer media, said first fluid medium and said second fluid medium having a temperature differential sufficient to cause heat transfer from one of the heat transfer media to the other of the heat transfer media; and causing heat transfer through said heat exchange conduit by passing one of the heat transfer media along said turbulent heat exchange chamber and passing the other of the heat exchange medium along the spirally coiled portion of the heat exchanger, said using flow control surfaces includes arranging fingers in annular spaced and generally parallel pathways between said supply chamber to a discharge chamber intercepting said helical pathway at consecutive helical convolutions to impart turbulence to said heat exchange pathway.

7. The method according to claim 6 wherein said spirally coiled portion of a heat exchange conduit consists of titanium.

8. The method according to claim 6 including the further step of providing a water inlet port communication with said supply chamber for directing the first fluid medium perpendicular to the direction of flow by the first fluid medium in said turbulent heat exchange chamber for enhancing turbulence in the supply chamber.

9. The method according to claim 6 wherein said turbulent heat exchange chamber is formed by a helical heat exchange chamber in a baffle bounded about an outer circumference by a shell.

10. The method according to claim 6 wherein said turbulent heat exchange chamber has a helical pitch which is essentially the same pitch of the spirally coiled portion of said heat exchange conduit, said method including the further step supporting the spirally coiled portion of said heat exchange against displacement in opposite directions in said turbulent heat exchange chamber.

11. The method according to claim 6 wherein said helical heat exchange chamber in a baffle and said shell consist essentially of plastic.

12. The method according to claim 6 including the further step of creating a turbulent flow of said first fluid medium in said supply chamber.

13. A heat exchanger to thermally condition a fluid medium exchanger including the combination of:

a shell including end walls forming an elongated internal cavity for heat transfer between fluid media;

shell conduits forming an inlet port and an outlet port arranged at spaced sites along said elongated cavity for conducting a flow of a first fluid medium of said fluid media;

an elongated baffle having a helical grove in the outer surface thereof and fingers in annular spaced and generally parallel pathways lying between said inlet port and said outlet port and intercepting said helical groove at consecutive helical convolutions to impart turbulence to an elongated heat exchange chamber between an inner periphery of said shell and said baffle; and an elongated tubular conduit for conducting a flow of a second fluid medium of said fluid media, said elongated tubular conduit having a coiled portion extending in a helical fashion and resident in said elongated heat exchange chamber for heat transfer with said first fluid medium while resident in and flowing at least substantially along said coiled portion of said elongated tubular conduit.

14. A heat exchanger to thermally condition a fluid medium including the combination of:

a shell including end walls forming an elongated internal cavity for heat transfer between fluid media;

shell conduits forming an inlet port and an outlet port arranged at spaced sites along said elongated cavity for conducting a flow of a first fluid medium of said fluid media;

a baffle elongated to extend along said elongated internal cavity and define therewith an elongated helical heat exchange chamber between an inner periphery of said shell and said baffle, said baffle having an outer cylindrical surface containing a helical arrangement of projecting flow control surfaces for impact with said first fluid medium; and an elongated tubular conduit for conducting a flow of a second fluid medium of said fluid media, said elongated tubular conduit having a coiled portion extending in a helical fashion and resident in said elongated helical heat exchange chamber with said flow control surfaces for maximizing heat transfer with said first fluid medium while resident in and with turbulent flow of said first fluid medium by said flow control surfaces flowing at least substantially along said coiled portion of said elongated tubular conduit, one of said end walls defines with said baffle a supply chamber containing flow control vanes extending radially from a central hub and protruding in said supply chamber from said end wall and upstanding posts traversing the weight of the supply chamber for imparting turbulence to an incoming flow of fluid media.

* * * * *